United States Patent [19]

Ehemann et al.

[11] Patent Number: 4,700,975

[45] Date of Patent: Oct. 20, 1987

[54] SKI POLE AND SNOW SUPPORT ELEMENT FOR A SKI POLE

[76] Inventors: Gero Ehemann, Birkenweg 15, 2833 Gross Ippener; Klaus Mainz, Vollersweg 9, 2875 Ganderkesee, both of Fed. Rep. of Germany

[21] Appl. No.: 865,653

[22] Filed: May 16, 1986

Related U.S. Application Data

[63] Continuation of Ser. No. 573,125, Jan. 23, 1984, abandoned.

[30] Foreign Application Priority Data

| | | | |
|---|---|---|---|
| Jan. 26, 1983 | [DE] | Fed. Rep. of Germany | 3302556 |
| Jul. 19, 1983 | [DE] | Fed. Rep. of Germany | 3325900 |
| Nov. 11, 1983 | [EP] | European Pat. Off. | 83111292.5 |

[51] Int. Cl.[4] ..... A63C 11/24

[52] U.S. Cl. ..... 280/824

[58] Field of Search ..... 280/824, 819

[56] References Cited

U.S. PATENT DOCUMENTS

| | | | |
|---|---|---|---|
| 3,163,437 | 12/1964 | Phillipson | 280/824 |
| 3,199,886 | 8/1965 | Dover | 280/824 |
| 4,014,559 | 3/1977 | Funke | 280/824 |
| 4,093,250 | 6/1978 | Wikstrand | 280/824 |

FOREIGN PATENT DOCUMENTS

| | | | |
|---|---|---|---|
| 242891 | 1/1912 | Fed. Rep. of Germany | 280/824 |
| 1478108 | 8/1969 | Fed. Rep. of Germany | 280/824 |
| 821737 | 12/1937 | France | 280/819 |
| 1427561 | 12/1965 | France | 280/824 |
| 1448257 | 6/1966 | France | 280/824 |
| 426891 | 11/1947 | Italy | 280/824 |
| 58408 | 9/1937 | Norway | 280/819 |
| 161080 | 4/1933 | Switzerland | 280/824 |
| 436071 | 11/1967 | Switzerland | 280/824 |
| 545635 | 2/1974 | Switzerland | 280/824 |

*Primary Examiner*—David M. Mitchell

*Attorney, Agent, or Firm*—Wegner & Bretschneider

[57] ABSTRACT

A ski pole with a ski pole rod and snow support element, whereby the snow support element is attached to a lower end zone of the ski pole rod and has a downwardly open shell element with a deflecting collar and with a rim for contacting a snow surface and preventing slippage of the pole with respect to the snow surface.

18 Claims, 11 Drawing Figures

Figure 1:
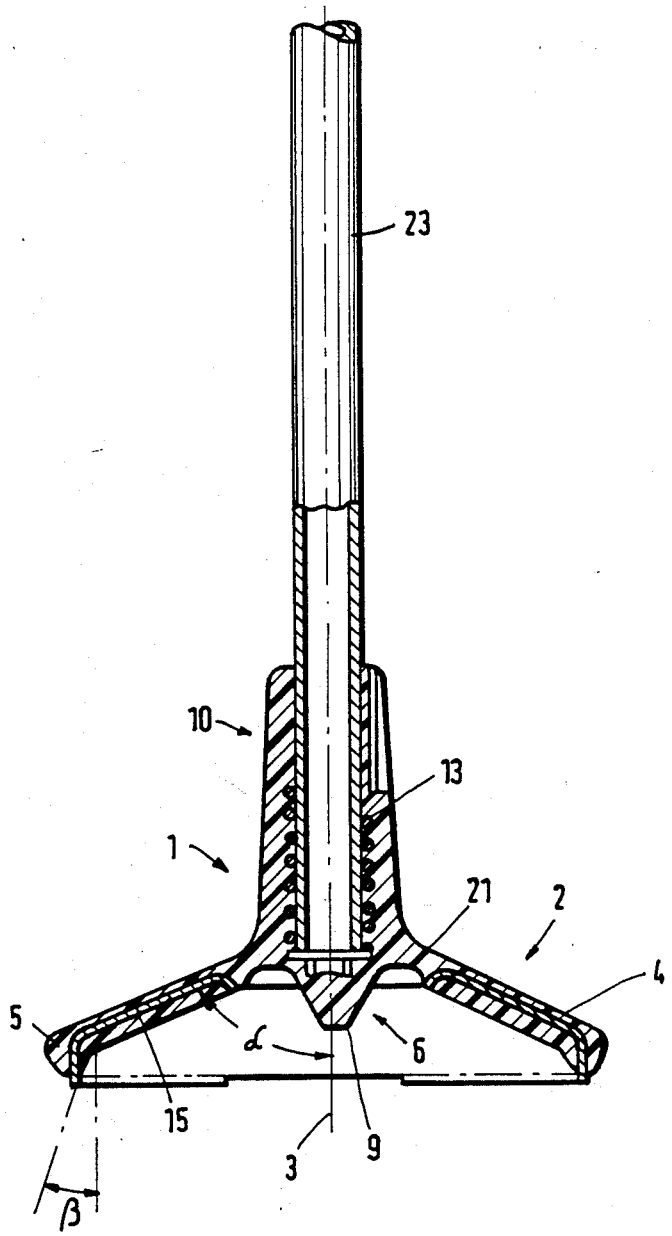

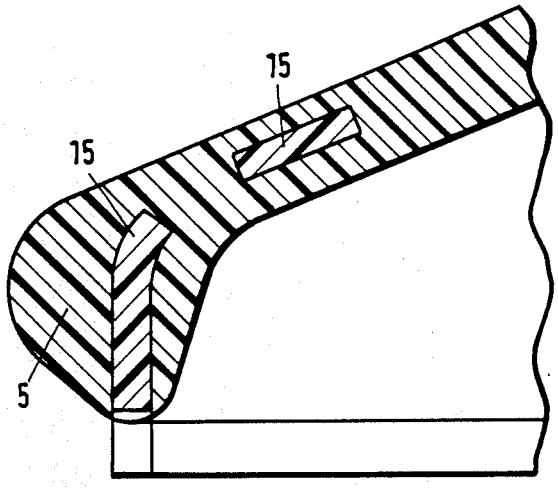
Fig. 5
Fig. 8
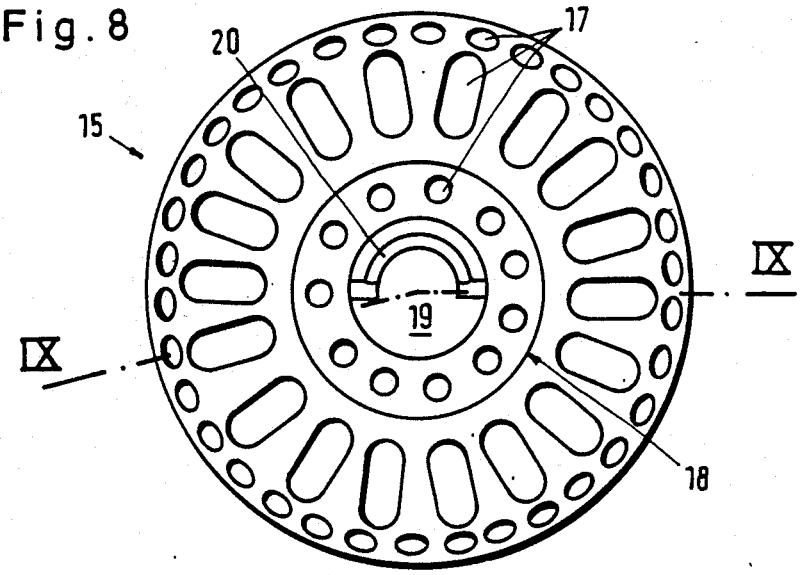
Fig. 9
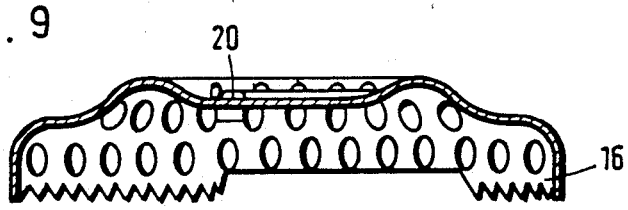

SKI POLE AND SNOW SUPPORT ELEMENT FOR A SKI POLE

This application is a continuation of U.S. application Ser. No. 573,125, filed Jan. 23, 1984, now abandoned.

The invention relates to a ski pole with a ski pole rod and a snow support element attached at the lower end of the ski pole rod, said support element being designed at least partially as a shell element open toward its bottom.

Ski poles, as is known, serve during skiing as an aid for enhancing the skier's balance, for changing direction and for support during jumping. Particularly in the case of cross-country skiing, the ski poles essentially serve to afford a more powerful pushoff and for initiating and maintaining forward motion.

Known ski poles are constructed in such a way as to exhibit at their lower end a so-called snow ring, an essentially circular, flat element which prevents the ski pole from penetrating too deeply into the snow. The lower end of the ski pole rod is generally designed with a more or less pointed taper so as to prevent the ski pole from slipping away. With such designs the snow ring is generally placed at a distance of a hand's breadth above the sharply tapering lower end of the ski pole rod.

A ski pole has already been proposed wherein the ski pole point has been replaced by a shell element which is open toward the bottom (cf., eg.g., CH-PS 545 635). With a ski pole according to this proposal the danger is eliminated of the sharply pointed lower end of the ski pole rod causing injuries in the event of a fall or other circumstances. However, a ski pole of the type according to this proposal is still subject to various disadvantages which can be recognized by the fact that a ski pole in accordance with this principle, namely with the ski pole point replaced by a downwardly open shell element, has not to date been successful to the degree that might be desirable for reasons of safety. Thus the snow support element known from the above mentioned document is generally designed with a uniform wall thickness or with one increasing in its upper zone. When the ski pole is applied to a relatively hard snow surface, depending on the material properties of the snow support element, a variable behavior can result. If the snow support element consists, e.g. of a relatively hard plastic, the snow support element can bend inward only slightly so that on an uneven base or in the event of an anticipatory or backward application of the ski pole by the skier, only a partial application of the snow support element on the snow base occurs. At the same time the skier feels in his hand a more or less strong deflecting reaction force. If, on the other hand, the material of the snow support element chosen is relatively soft, the snow support element buckles inward uncontrollably under eccentric stresses according to the specific conditions of application. Since in this case the rim zone is also relatively soft, the snow support element can completely buckle so that the rim of the shell element no longer rests on the snow surface and the ski pole depending on the circumstances, cannot grip at all.

A safe application and gripping with the known ski pole is furthermore not always possible in a satisfactory fashion since, e.g. on icy surfaces or those with a relatively thin snow cover, the snow support element can find no hold.

Starting from the previously presented state of the art, the invention relates to a ski pole exhibiting, like the previously described known ski pole, a relatively small potential for injury, though exhibiting with respect to strength, safety from slipping and ease of handling, substantially better characteristics.

Said aim is primarily and essentially attained by the shell element exhibiting a deflecting collar. According to the invention, a defined place or a defined zone is created in the shell element which makes possible a jointlike movement of the ski pole rod relative to the portion of the shell element located below the deflecting collar. Even with oblique application or pushoff of the ski pole there is the assurance that the snow support element is fully applied in a rim zone on the snow cover. As a result of the collar provided by the invention, only a slight but not bothersome recoil force in the skier's hand is produced by oblique application of the ski pole or when pushing off.

In principle, the deflecting collar, according to the invention, can be designed in various ways. For example, there could be strutlike connections, somewhat like spring poles operating between the shell element and the ski pole rod, or a simple helical spring with corresponding elasticity constant. In the embodiment of the invention it is preferably provided that the deflecting collar be made with a reduced wall thickness in the zone integrated into the shell element. This embodiment has shown itself to be advantageous since no additional single components designed solely for this function are required, no zones are created where snow or ice can accumulate—something which is generally found to be disturbing if only for reasons of weight. Such an embodiment can, in particular, save space and weight. In contrast with a rigid shell element, the embodiment of the invention exhibits other more advantageous characteristics since in the event of falls, awkward manipulation during skiing and similar occasions, the shell element can follow jointlike stresses in this zone which is also advantageous with respect to safety.

The ski pole, according to the invention, can, in detail, be designed in various ways. Preferably it is provided above all that the shell element be made axially symmetrical to a center line. With respect to the external design of the snow support element, it must be assured that a catching or edging of the snow support element and consequently of the ski pole are avoided as far as possible. In addition, such an embodiment of the snow support element leads to relatively uniform reaction forces within the snow support element when applied to the snow surface. Individual zones of the snow support element are not stressed as by an increased lever effect.

Further, the snow support element is preferably designed with an essentially straight flank zone when viewed in cross section, this flank zone enclosing a flank angle with the cneter line. This flank angle is, as a rule, an acute angle, whereby through variation of the angle and a width of the flank zone, the downward open cavity of the snow support element is essentially determined.

When in the preceding and in the following text, the designation "below" or "above" is used, it is always assumed that the ski pole is viewed in its normal position. "Below" thus signifies the direction toward the snow surface and "above" the opposite direction.

With respect to the flank zone, a flank angle of about 70° between the flank zone and the center line has been found to be advantageous. The advantage is that with such an angle the cavity enclosed between the snow support element and a snow surface is relatively flat, so that even in the event of relatively thin snow cover a compression effect occurs which increases the slipping safety of the ski pole.

In another embodiment, which is independently significant, the flank zone phases off into a rim zone, whereby the rim zone with the center line encloses a rim angle deviating from the flank angle. In relation to the center line this is generally a more acute angle, i.e. the rim zone in relation to the flank zone is offset, deviating from the center line.

It has been found to be advantageous to make the rim zone in such a way that essentially in cross section it appears to taper wedgelike toward the bottom. This means that with respect to an outer surface of a flank zone the transition of the flank zone to the rim zone is bulge-shaped. The result is that in applying the ski pole to a snow surface, the compression effect described earlier takes place not only in the interior of the snow support element but also in the exterior rim zone. Even in the event of only partial stressing of the snow support element, as in the case of an undulating subsurface, a merely partial application of the snow support element to a snow mass formed in the interior of the snow support element as well as an application of the snow support element to externally compressed snow zones at the subsequent semicircle prevents the ski pole from slipping.

In a further embodiment which is also important for substantially improved support characteristics, the snow support element is provied with a conical center protrusion projecting downward in the zone of the center line. This center protrusion increases the application surface of the snow support element on the snow mass forming in the downward protrusion of the snow support element and provides a central application point which is advantageous in uneven terrain conditions. The center protrusions can have the form of a double cone, whereby a pointed cone section projecting further downward exhibits a lesser cone angle than does an upwardly adjacent flat cone. In total, however, the point of the center protrusion is designed to project only so far downward that with the application of the snow support element to a snow surface that is primarily and essentially the wall zone which comes into contact with the snow surface.

In another advantageous embodiment the snow support element is provided with an upwardly extending mounting shaft for mounting the ski pole. The mounting shaft is designed with an essentially cylindrical mounting opening.

As a characteristic, a grovelike slit opening only to the outside is provided in the mounting shaft, running vertically in the mounting shaft. This slit has proven to be advantageous insofar as it facilitates an insertion of the ski pole rod into the mounting shaft, serving as a "preset expansion zone."

For the purpose it is also advantageous that the mounting opening be made conically expanding in an upper zone so that the ski pole rod can be inserted relatively easily into the mounting opening and that a substantial insertion resistance must be overcome only after a certain insertion depth.

It has been shown to be particularly advantageous to make the mounting opening as at least partially extending into the center protrusion. The lower end of the ski pole rod thus has a relatively small distance in terms of height from the rim zones, which in the case of the typical "working" of the ski pole rod occurring during skiing, namely a more or less strong deviation from the vertical, leds to one of the unstressed rim zones not being raised from a snow surface. The flank angle selected is also jointly responsible for this success.

In another embodiment which is also significant on its own account, a helical spring element is integrated into the mounting shaft in such a way that an axis of symmetry of the helical spring element coincides with the rotational axis of the snow support element. Besides a certain reinforcement of the stability of the mounting shaft, the helical spring element is very significant in relation to the mounting of the ski pole rod in the mounting shaft. For this purpose the helical spring element is chosen with such a diameter that one or more screw threads in the interior of the mounting opening are left at least partially bare. It is advantageous that the screw threads be left bare in the conical zone of the mounting opening, while those in the cylindrical zone of the mounting opening (even if only a few of them) are covered by the inner surface of the mounting opening.

Upon insertion of a ski pole rod into the mounting opening, the helical spring element simultaneously cuts threadlike grooves into the ski pole rod so that anchoring of the ski pole rod in the mounting opening is achieved not only as a result of its pressure setting but a screw seating also takes place. with respect to this function the helical spring element can be made of aluminum since it is not a question of significant elastic properties.

The shell element istelf is preferably plastic, whereby it is advantageous to choose a plastic with a polyethelene base, such as Anitel EN 400 (Enka Werke) having a Shore hardness of 40 D.

A structural element cn be integrated into the plastic element, this being essentially adapted to the form of the shell element. While the structural element is placed in the flank and rim zones within the interior of the shell element, it is advantageous that it project downward from the rim zone in the form of an exposed contact edge not surrounded by plastic. This affords the possibility of forming separate gripping edges which additionally reinforce a slideproof application of the ski pole to a snow surface. The contact edges are provided for this purpose with a large number of sawtoothlike points. These points, however, are not provided over the entire circumference of the rim zone, but only in zones, totalling some $\frac{2}{3}$ of the circumference of the rim zone.

In making the deflecting collar the structural element is advantageously made only for the flank and rim zones so that it is, with the exception of the rim zone, made like a cup spring. It is equally conceivable that the structural element be made in the zone of the deflecting collar, being of course in large measure bendable in this zone.

In a further advantageous embodiment, the structural element is provided with recesses, particularly in the rim zone, the flank zone and the central protrusion (if provided) of the zones of the structural element associated with the snow support element. These recesses primarily facilitate the production of the structural element with relatively light weight which is generally of advantage for the functional efficiency of the ski pole, i.e. for the quickest possible and unimpeded application of the ski pole to a desired point. In addition to this it was found surprisingly that the recesses are particularly advantageous in connection with the embedding of the structural element in the plastic body. The plastic which is generally present in the zone of the recesses generates a multiple rivetlike cramping of the plastic to the upper side of the structural element with the plastic on the underside of the structural element. Therefore, the recesses are also present in the rim zone, in any case in those zones of the rim zone in which a contact edge is formed, since the wedgelike design of the rim zone, as further described above, also generates certain reaction forces upon the plastic and seeks to force it back. The rivetlike cramping of the plastic also serves to eliminate almost completely a loosening of the plastic from the structural element even in these rim zones.

If the structural element is also embodied in the zone of the center protrusion, it also exhibits there essentially the form of an upwardly open structural element cup. In a cup base of the structural cup a screw thread is formed which serves for the interlocking connection of the helical spring element with the structural element. In addition, a helical spring stop is made at an underside of the cup base so that only a final turn of the helical spring can be turned into the screw course before it hits the helical spring stop. The function of the interlocking connection of the helical spring with the cup base is thus achieved and excessive screwing is prevented.

In addition, the structural element, like the spiral spring element, is preferably made of aluminum. A hardening of the structural element has been found advantageous especially in regard to the contact edges, which are thereby substantially protected against abrasion.

Particularly if the hardening is undertaken by the formation of a relatively heavy aluminum oxide layer, e.g. in a layer thickness of 30–50 $\mu$m, or made by flame coating in a plasma process, there results a sursprising effect with respect to the adhesion of the plastic to the structural element.

The above mentioned hardening processes roughen the surface of the structural element to a substantial degree, facilitating an intensive adhesion of the plastic to the structural element.

Even though the snow support element has been described above as part of a ski pole according to the invention, the teaching of this invention is not, however, directed solely to a completed ski pole. On the contrary, this invention also relates to a snow support element alone which can be attached to the ski pole rod of a known ski pole to make harmless the ski pole point of the known ski pole. Of course, at the same time the snow ring attached to such a ski pole can also be eliminated since it is no longer necessary for the functioning of a converted ski pole.

Alternative to the above described embodiment of the snow support element, it can also be advantageous to make the snow support element, at least in its interior profile, in an approximately semi-elliptical shape.

A use of the ski pole which will rule out its skidding can also be substantially reinforced by the downward pointing rim zone of the snow support element exhibiting crenellated protrusions. These crenellated protrusions can be provided, e.g. in the case of an all-plastic element in the element itself, or if a structural element is provided, only in the structural element or in both the structural element and the plastic element. In operative contact with the snow these crenellated protrusions also generate a stability of the ski pole according to the invention along its longitudinal axis. A further advantage of a snow support element made in such a way is that it allows an enhancement of the gripping capability of the ski pole according to the invention through the formation of crenellated protrusions so that pointed protrusions in the rim zone of the snow support body are not absolutely necessary. It has been found advantageous to make the crenellated protrusions by providing regularly distributed semicircular recesses along the circumference of the rim zone.

The snow support element can also exhibit in the zone of its center line an upwardly extending cylinder lug. The importance of this cylinder lug, which preferably exhibits at its top an end in the form of semispherical cap, lies primarily in offering the possibility of a simple centering fastening for the spring element which, as explained above, is provided in the mounting shaft. The cylinder lug thus is especially suitable for attaching a mounting element which makes possible a fastening of a downwardly directed element extending into the interior of the snow support element. In particular, this can be a point comparable to a traditional ski pole point. The insertion of such a point in the interior of the snow support element still largely excludes a danger of injury by the surrounding snow support element and can in certain applications result in an even greater skid resistance of the ski pole.

The mounting element in the interior of the cylinder lug can be of simple design, e.g. a tubular element exhibiting an inside screw thread which is connected to the cylinder lug by adhesion, welding or another means. Similarly, as in the case of soccer shoes whose cleats can be interchanged depending upon the type of ground, a ski pole point can be provided with the capability of interchange.

Further details of the invention can be seen from the following description of the drawing which merely shows embodiments.

Figure 2:
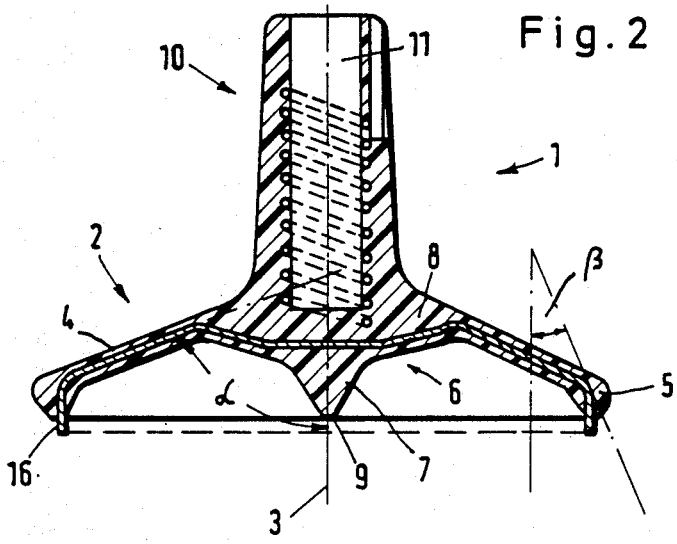
Figure 4:
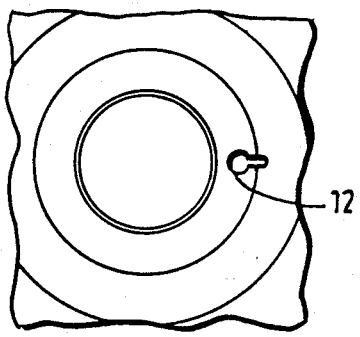
Figure 3:
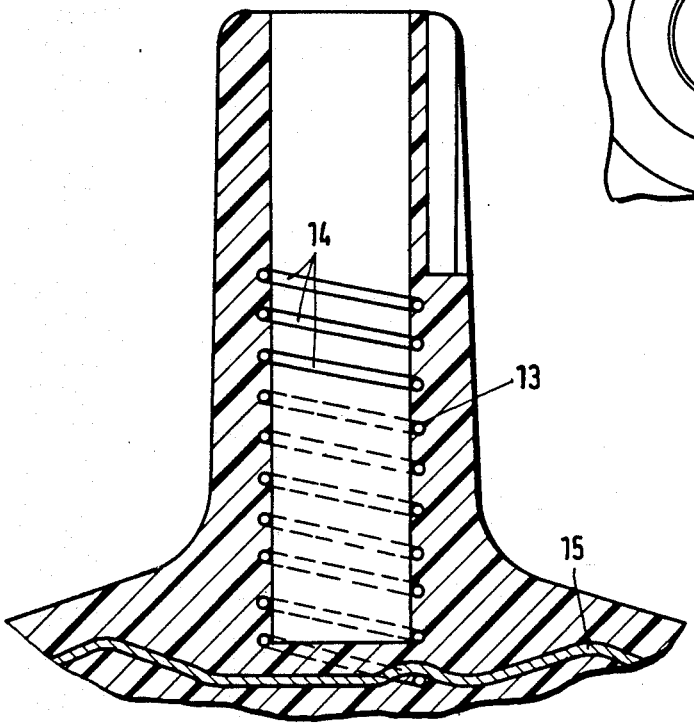
Figure 6:
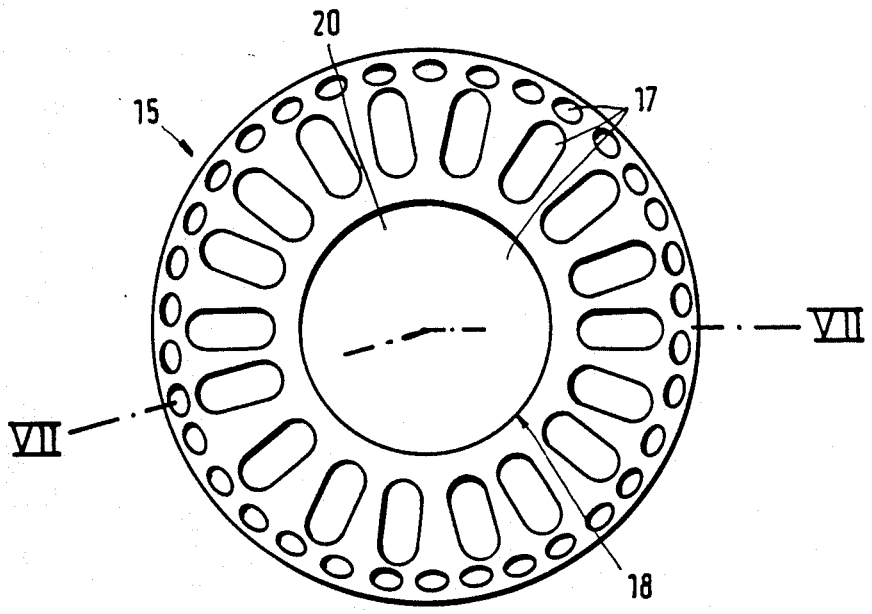
Figure 7:
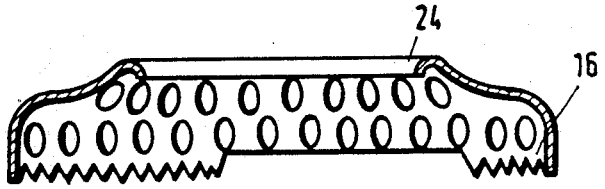
Figure 10:
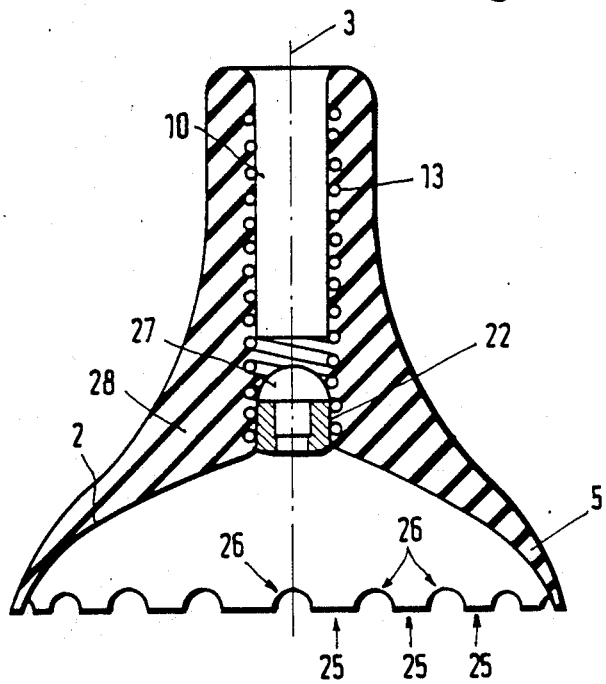
Figure 11:
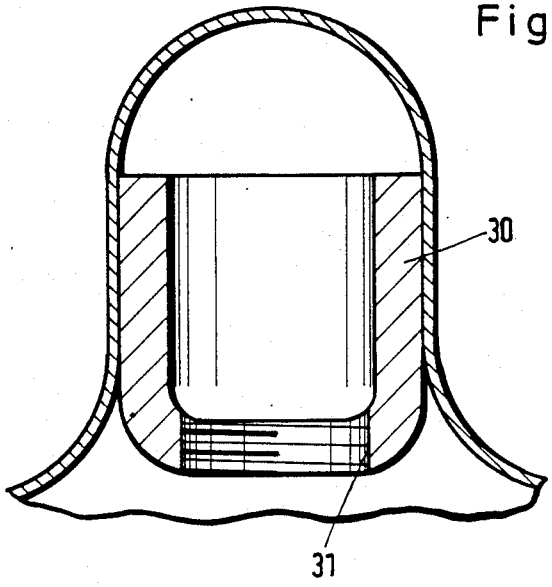

The attached drawing illustrates:

FIG. 1 a ski pole, according to the invention, in partial cross section;

FIG. 2 a cross section through a snow support element in an alternative embodiment;

FIG. 3 a representation of the snow support element according to FIG. 2 in enlarged scale, whereby, however, essentially only the mounting shaft is shown;

FIG. 4 a top view of the object according to FIG. 3;

FIG. 5 an enlarged representation of the rim zone of the snow support element in a representation according to FIG. 1;

FIG. 6 a top view of the structural body in a snow support element according to FIG. 1;

FIG. 7 a representation according to FIG. 6, in section along line VII—VII;

FIG. 8 a top view of a structural body of a snow support element according to FIG. 2;

FIG. 9 a representation in accordance with FIG. 8, in section along the line IX—IX;

FIG. 10 a cross section through a snow support element in an additional alternative embodiment, and FIG. 11 a partial enlargement of a cylinder lug as shown in FIG. 10.

The snow support element 1 of a ski pole according to the invention, as well as a ski pole 23 connected to the snow support element is shown diagrammatically in FIG. 1.

As can be seen primarily from FIG. 1, the snow support element 1 consists of a shell element 2 with a mounting shaft 10 formed on the shell element.

A deflecting collar 21 is integrated into the shell element 2, which in the embodiment is shown as a zone of reduced wall strength of the shell element 2. From FIG. 1 it can be seen that the deflecting collar 21 comes into view on the outside through a circular ring-shaped recess in the interior of the shell element 2 though on the surface (facing the skier) of the shell element 2 it cannot be seen.

Even though in the embodiment according to FIG. 1 a structural element 15, further described in detail below, is provided integrated into a plastic element, the ski pole according to the invention can also be produced with a snow support element consisting completely of plastic.

The shell element is designed axially symmetrical to a center line 3 and exhibits an essentially straight running flank zone 4 which encloses, with the rotational axis 3, a flank angle $\alpha$ of about 70°. The flank zone 4 phases out into a rim zone 5 which wit the center line encloses a rim angle deviating from the flank angle. As can be seen from FIG. 2, the rim angle is defined with reference to a middle course of the rim zone 5. However, in the embodiment the inner rim zone 5 also runs in correspondence with rim angle $\beta$. The rim angle preferably amount to about 20°.

As can be seen particularly from FIG. 5, the rim zone 5 in cross section is designed basically in a wedge shape tapering downward.

In addition, the snow support element 1 in the zone of the center line is designed with a conical, downwardly projecting center protrusion 6. It can be seen that the center protrusion 6 in the case of the embodiment according to FIG. 2 has the form of a double cone. In the case of the embodiment according to FIG. 1 it has the form of a simple cone. In the case of the double cone a downwardly projecting cone section 7 and an upwardly adjacent flat cone section is provided.

Altogether the center protrusion 6 is provided in such a way that one point 9 is designed with only such dimensions projecting downward, that upon resting of the snow support element 1 on an even support surface only the rim zone 5 is in contact with the support surface.

In addition, the snow contact body 1 exhibits a structural element 15 placed essentially in the interior of the shell element 2, this being shown by itself in FIGS. 6, 7, 8 and 9. In the rim zones 5 the structural element projects out from the shell element 2 to form contact edges 16. As can be seen e.g. from FIGS. 7 and 9, the contact edges 16 are not designed continuously but only ver about $\frac{2}{3}$ of the circumference of the rim zone 5.

The structural element 15 is additionally designed with recesses 17, some of which are oblong and other circular.

In the zone of the structural element 15 associated with the center protrusion 6 of the shell element 2, in the case of the embodiment according to FIG. 2, this structural element is designed as an upwardly opening structural element cup as can be seen especially in the section according to FIG. 9. In a cup base 19 of the structural element cup 18, a screw thread 20 is formed, serving for the interlocking attachment of the helical spring element 13, described below, with the structural element 15. A final turn of the helical spring element 13 is to be threaded into the screw thread 20, whereby the end of the helical spring element 13 hits, after about one rotation, the helical spring stop 20 provided on an underside of the cup base 19.

In the case of the embodiment according to FIG. 1, on the other hand, the structural element 15 is designed in its upper zone with a circular ring-shaped recess to assure a sufficiently easy freedom of movement for the deflecting collar 21. It is advantageous in this case to design the rim of the structural element 15 with a rim bead 24. This aids in preventing the plastic from cracking open at the point of transition of the structural element 15 and the plastic element The mounting shaft 10 (FIG. 3) of the snow support element 1 is provided with an essentially cylindrical mounting recess 11 which is designed with a conical expansion in its upper zone.

The mounting recess 11 in its lower zone projects into the center protrusion 6 which, in the case of the embodiment according to FIG. 2, is possible through the protrusion of the structural element cup 18.

With respect to the helical spring element 13 it should also be pointed out that in the case of the embodiment according to FIG. 1, it is integrated, so to speak, "free-floating" into the mounting shaft 10.

As already indicated, the snow support element 1 is preferably produced from plastic while the structural element 15 and the helical spring element 13 are aluminum.

The helical spring element 13 which is connected to the structural element in an interlocking manner, is placed in the mounting shaft 10 in such a way that it is covered in the cylindrical section of the mounting opening 11 by the surface of the mounting opening 11, though individual threads 14 in the conical zone of the mounting opening remain at least partially open.

In addition the mounting shaft 10 is equipped with a groovelike slip 12 opening outwardly (cf. esp. FIG. 4).

In connection with FIG. 5 it can be seen that the protrusions 17 provided in the structural element 15 facilitate a rivetlike cramping of the plastic to the structural element 15.

In the embodiment according to FIG. 10 the snow support element 1 is designed in its interior essentially in the shape of a semi-ellipse.

In the downward pointing rim zone 5 of the snow support element 1, crenellated protrusions 25 are provided in this embodiment. The crenellated protrusions 25 are the result of semicircular recesses 26 provided at regular intervals in the rim zone 5 of the snow support element.

In the embodiment according to FIG. 10, the snow support element 1 upwardly exhibits a cylinder lug 22 in the zone of the center line 3. At the top the cylinder lug 22 is closed in the form of a semispherical cap. The ski rod (not shown) is connected in this case to the snow support element 1 by way of the helical spring element 13. The helical spring element 13 overlaps the cylinder lug 22 in an end zone. Here the helical spring element 13 can also assume a spring deflection and joint can also assume a spring deflection and joint function, in which case it is then, of course, made of steel. The helical spring element 13 and the snow support element 1 in this embodiment are vulcanized in a rubber or plastic element 28 (the shell element 2 is therefore also a metal element).

As can be seen particularly in FIG. 10, the rubber element 28 surrounds the shell element 2 with a thickness diminishing toward the rim zone 5 of the shell element 2. In the zone of the helical spring element 13 the rubber element 28 is additionally designed in a basically cylindrical shape so that altogether in cross section an approximately bell-shaped form is achieved.

The cylinder lug 22 exhibits a mounting element 30, with which a downwardly pointed element can be fastened removably in the cylinder lug 22 and thereby in the snow support element 1. This element can, e.g. be a point. The cylinder lug 22 or the mounting element 30 is advantageously provided with an inner wall 31 so that the point to be fastened can be screwed into the cylinder lug 22.

The characteristics of the invention disclosed in the preceding description, in the drawing as well as in the claims, can both individually and in any desired combination, be fundamental for the practice of the invention in its various embodiments.

We claim:

1. A ski pole which comprises a ski pole rod and a snow support element attached to a lower end of the ski pole rod, said snow support element having a downwardly open shell element with a deflecting collar, said shell element having a flank zone and a rim zone, said snow support element further having a structural element adapted to the shape of the shell element located within the flank zone and extending through the rim zone and having a protruding edge protruding downwardly out of the rim zone, said snow support element further having a conical center protrusion pointing downward past the lower end of the ski pole rod in the vicinity of its center line, whereby during use a downward portion of the rim zone and the protruding edge of the structural element contact a snow surface to prevent slippage of said pole with respect to said snow surface.

2. A ski pole as in claim 1, wherein the snow support element is axially symmetrical to the axis of the ski pole.

3. A ski pole as in claim 1, wherein the flank zone in cross-sectional representation is substantially straight and defines an acute flank angle with the center line of the shell element.

4. A ski pole as in claim 3, wherein the flank zone passes into the rim zone, and the rim zone with the center line defines a rim angle different from the flank angle.

5. A ski pole as in claim 4, wherein the rim zone in cross section is a substantially downwardly tapering wedge formed by an outwardly-tapering inner surface and an inwardly-tapering outer surface.

6. A ski pole a in claim 1, wherein the snow support element further comprises an upwardly extending mounting shaft with a substantially cylindrical mounting opening open in only the upward direction for mounting to the ski pole.

7. A ski pole as in claim 1, wherein the snow support element is a plastic element.

8. A ski pole which comprises a ski pole rod and a snow support element attached to a lower end of the ski pole rod, said snow support element having a downwardly open shell element, said shell element having a deflecting collar with a zone of reduced wall thickness, a flank zone, and a rim zone, said snow support element furthe rhaving a structural element adapted to the shape of the shell element embedded within the flank zone and extending through the rim zone and having a protruding edge protruding downwardly out of the rim zone, whereby during use a downward portion of the rim zone and the protruding edge of the structural element contact a snow surface to prevent slippage of said pole with respect to said snow surface, and whereby when the snow support element contacts the snow surface, the shell element deforms primarily at the deflecting collar.

9. A ski pole as in claim 8, wherein the flank zone element in cross-sectional representation is substantially straight and defines an acute flank angle with the center line of the shell element.

10. A ski pole as in claim 9, wherein the flank zone passes into the rim zone, and the rim zone with the center line defines a rim angle different from the flank angle.

11. A ski pole as in claim 10, wherein the rim zone in cross section is a substantially downwardly tapering wedge formed by an outwardly-tapering inner surface and an inwardly-tapering outer surface.

12. A ski pole as in claim 8, wherein the snow support element further comprises an upwardly extending mounting shaft with a substantially cylindrical mounting opening open only in the upward direction for mounting to the ski pole.

13. A ski pole as in claim 8, wherein the snow support element is a plastic element.

14. A ski pole as in claim 8, wherein the snow support element is axially symmetrical to the axis of the ski pole.

15. A ski pole comprising a ski pole rod and a snow support element attached to a lower end of the ski pole rod, said snow support element having a downwardly open shell element which comprises:

a deflecting collar with a zone of reduced wall thickness;

a flank zone adjacent the deflecting collar which is substantially straight in cross-sectional representation and which forms an acute flank angle with the axis of the ski pole rod; and a rim zone adjacent the flank zone which in cross-sectional representation is a substantially downwardly tapering wedge formed by an outwardly-tapering inner surface and an inwardly-tapering outer surface, said rim zone forming a rim angle with the axis of the ski pole rod which is different than the flank angle;

said snow support element further comprising a structural element adapted to the shape of the shell element embedded within the flank zone and extending through the rim zone and having a protruding edge protruding downwardly from the downwardly tapering wedge;

whereby during use the downwardly tapering wedge and the protruding edge of the structural element contact a snow surface to prevent slippage of said pole with respect to said snow surface, and whereby when the snow support element contacts the snow surface, the shell element deforms primarily at the deflecting collar.

16. A ski pole as in claim 15, wherein the snow support element further comprises an upwardly extending mounting shaft with a substantially cylindrical mounting opening open in only the upward direction for mounting to the ski pole.

17. A ski pole as in claim 15, wherein the snow support element is a plastic element.

18. A ski pole as in claim 15, wherein the snow support element is axially symmetrical to the axis of the ski pole.

* * * * *